United States Patent [19]

Myers

[11] 3,937,888

[45] Feb. 10, 1976

[54] SIGNAL TRANSMISSION WITH SECRECY

[75] Inventor: Oscar Myers, Mount Vernon, N.Y.

[73] Assignee: Bell Telephone Laboratories, Incorporated, Murray Hill, N.J.

[22] Filed: July 17, 1943

[21] Appl. No.: 495,127

[52] U.S. Cl. ..... 179/1.5 C; 179/1.5 R
[51] Int. Cl.[2] ..... H04K 1/06
[58] Field of Search ..... 179/1.5, 1.5 R, 1.5 C

[56] References Cited

UNITED STATES PATENTS

| | | | |
|---|---|---|---|
| 1,605,023 | 11/1926 | Hartley | 178/22 |
| 1,676,321 | 7/1928 | Carpe | 178/22 |
| 1,981,114 | 11/1934 | Mitchell | 179/1.5 |
| 2,312,897 | 3/1943 | Guanella | 179/1.5 |
| 2,364,210 | 12/1944 | Guanella | 179/1.5 R |
| 3,012,099 | 12/1961 | Busch et al. | 179/1.5 C |
| 3,012,100 | 12/1961 | Mitchell | 179/1.5 C |

*Primary Examiner*—Maynard R. Wilbur
*Assistant Examiner*—H. A. Bermiel
*Attorney, Agent, or Firm*—H. A. Burgess; A. E. Hirsch

EXEMPLARY CLAIM

1. In a privacy system in which the signals are divided into fragments on a time basis and the different fragments are delayed in transmission by different amounts to afford privacy, a timing means having a timing cycle divided into several periods, a relay individual to each period and individually operated during its respective period by said timing means, a plurality of delay devices to introduce delay into said signals, means controlled by said timing means to select a delay device for each timing period, and means jointly controlled by said relays and selecting means to operate the selected devices.

12 Claims, 5 Drawing Figures

INVENTOR
O. MYERS

BY H. A. Burgess

ATTORNEY

INVENTOR
O. MYERS

BY H. A. Burgess

ATTORNEY

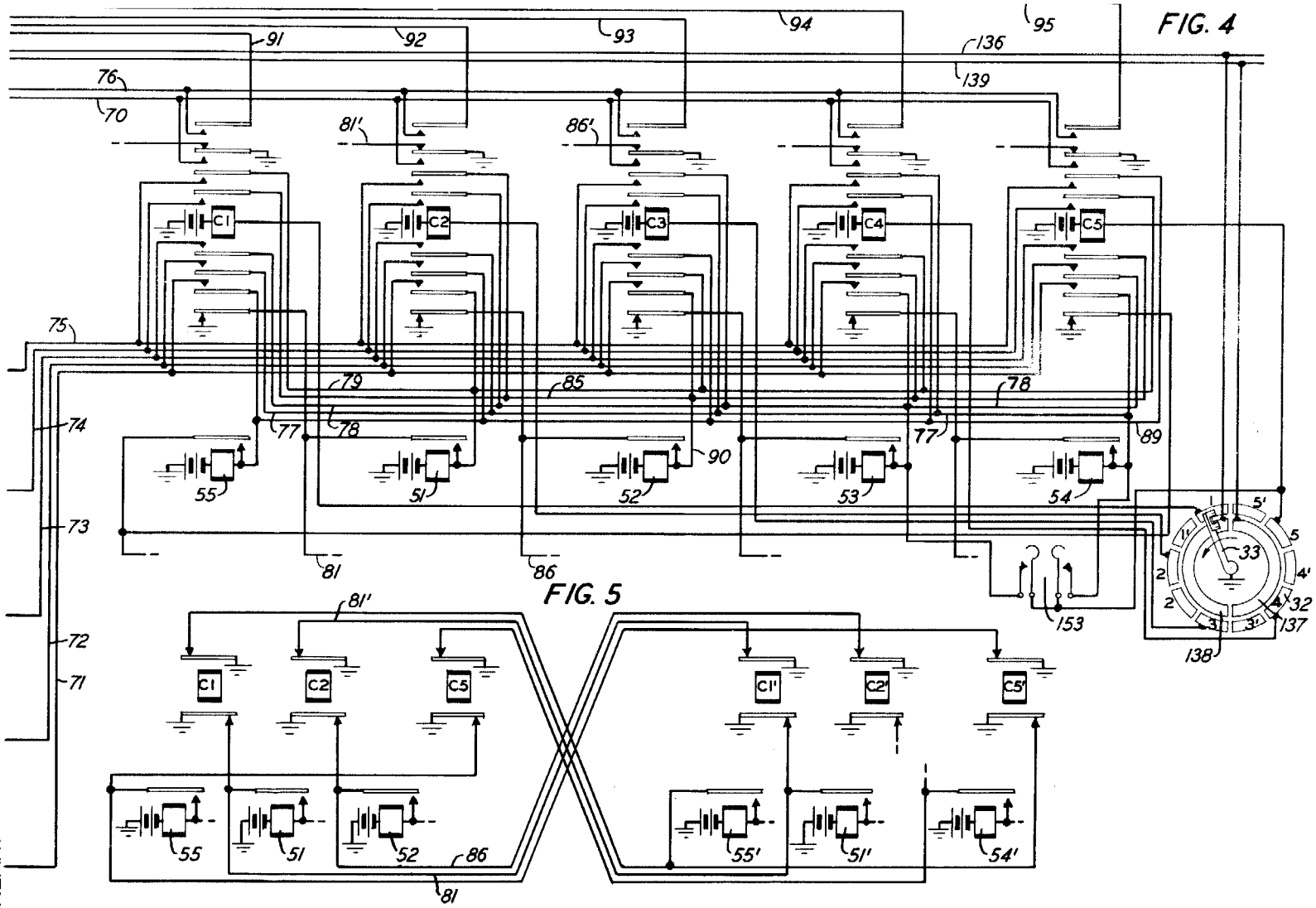
INVENTOR
O. MYERS
BY H. A. Burgess
ATTORNEY

SIGNAL TRANSMISSION WITH SECRECY

The present invention relates to message transmission with privacy in which the privacy is obtained by transmitting message fragments that are variably delayed in time so that as transmitted they occur out of their normal order. In order successfully to receive the message in intelligible form it is necessary to introduce variable delay into the message fragments as received in such manner as to rearrange them in their normal order.

One system operating in this manner and using code relays and scramblers in connection with a magnetic tape recorder as the delay device is disclosed in Busch-Cahill-Myers application Ser. No. 484,362, filed Apr. 24, 1943, now Pat. 3,012,099 granted Dec. 5, 1961.

The present invention is similar, in general, to that of the above application but is based upon a different manner of obtaining continuous coding resulting in a considerable saving in equipment.

An object of the present invention is to provide for coding and decoding of speech or similar signals with simplified apparatus still permitting a complex scheme of coding with a very large number of usable codes.

In accordance with the present invention, instead of setting up the code in advance of use, such as in the form of selected and locked-up relays, each element of the speech or signal is coded as it is sent (or is decoded as it is received) so that any one of the electromagnets that are located along the tape and that individually introduce the different amounts of delay is both selected and connected into circuit at one and the same time. In the embodiment to be disclosed this is accomplished by the use of fast-acting relays which are energized in response to the time division commutator brush coming onto a segment of the commutator. A circuit is closed, individual to each segment, which sets up a directively controlled path through the scrambler and through a contact of an exclusion relay (where necessary) to a relay which selects the electromagnet that is to serve for coding or decoding the speech element for that commutator segment interval. Since the selection is determined by the scrambler it can be made on a nearly random basis except as the selection has to be modified by the exclusion circuit to avoid sending the same element of the signal more than once and to insure sending all elements of the signal. The length of the code that can be used before repetition occurs is, therefore, very long and is limited only by the number of different delays that the apparatus provides. The difficulty of decoding is increased further by the fact that interlaced coding can be used with the system of the present invention.

The nature of the invention and its various features and objects will be more fully understood from the following detailed description taken in conjunction with the accompanying drawing in which.

Figure 1:
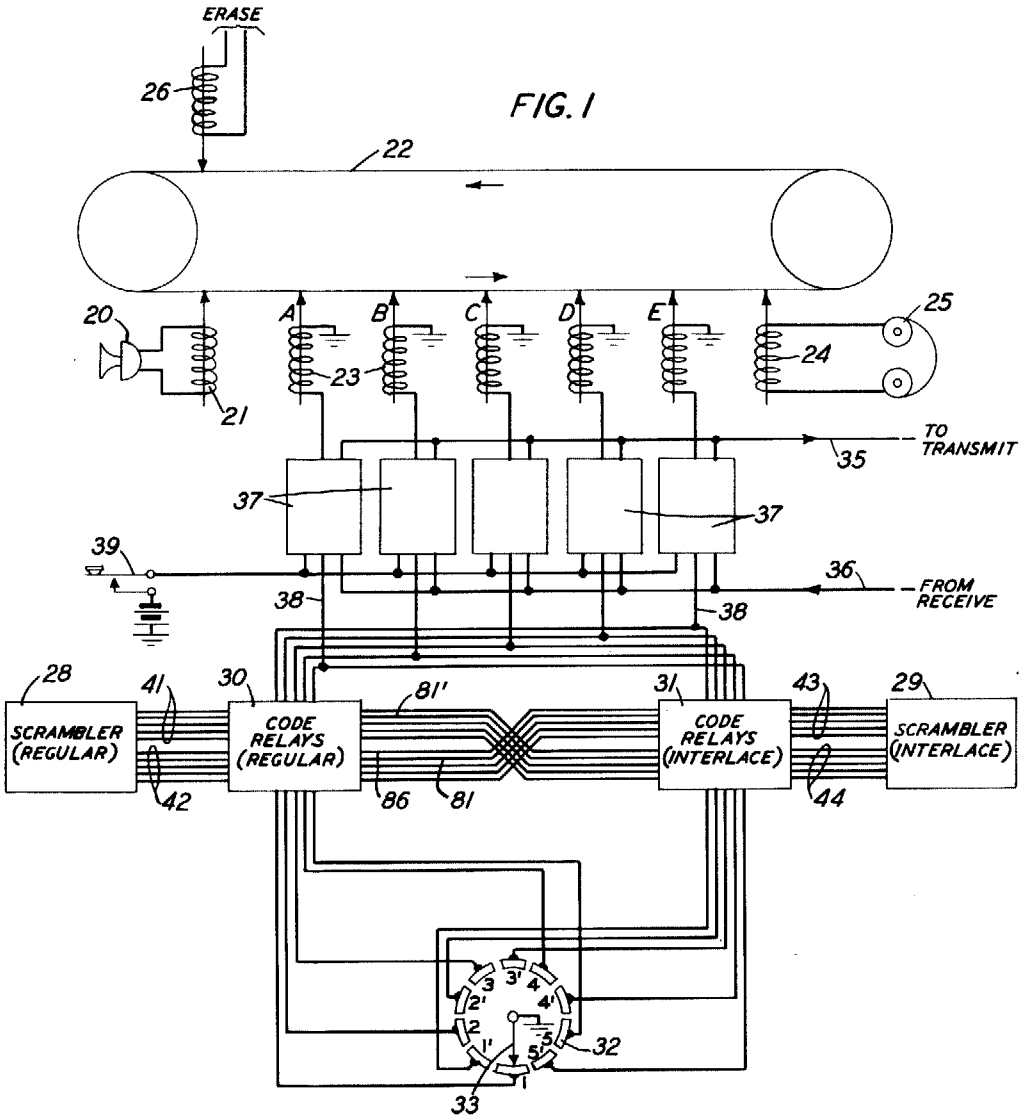
FIG. 1 is a schematic diagram of one complete two-way terminal of a telephone privacy system according to this invention.
Figure 3:
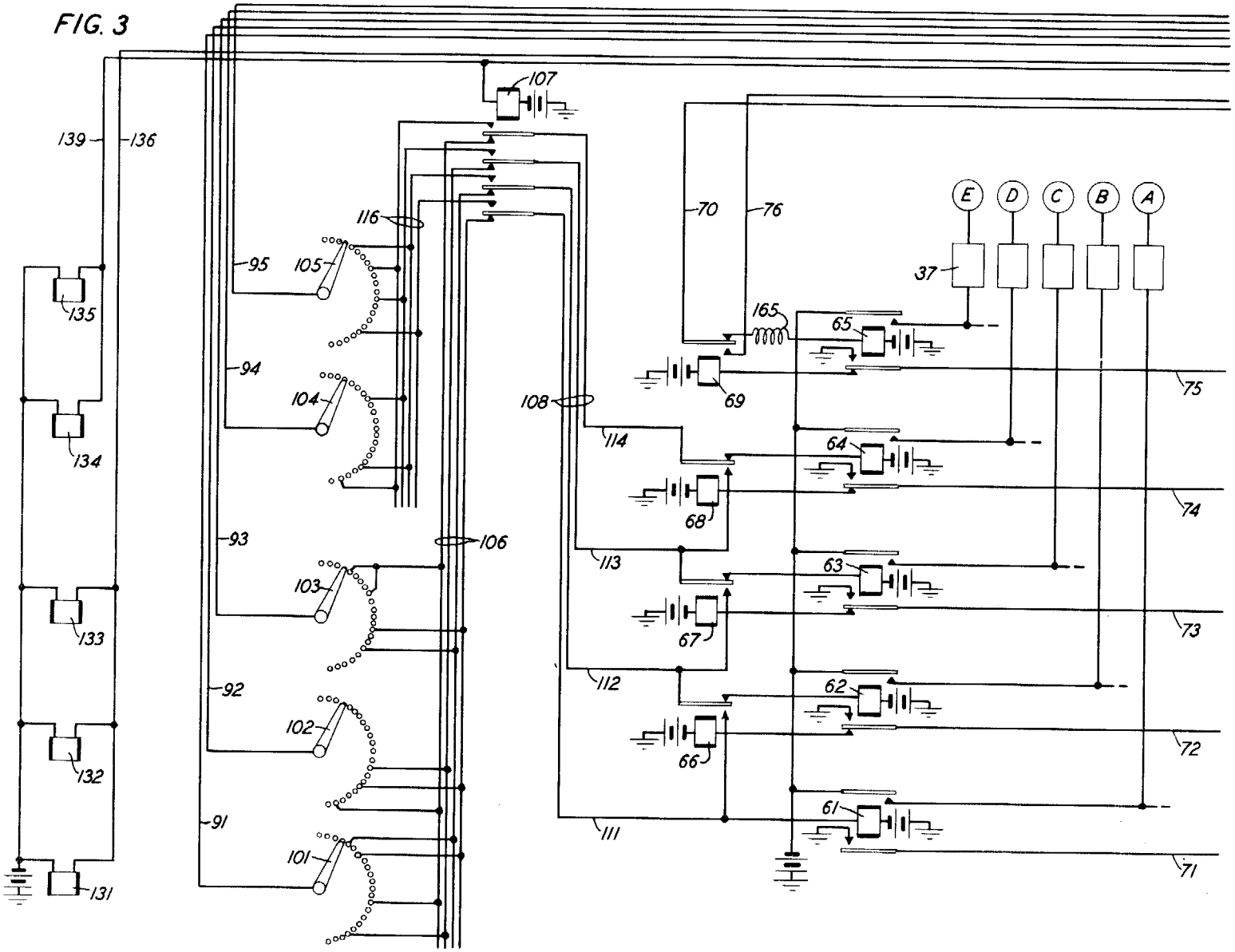

FIGS. 3 and 4 when placed together with FIG. 4 at the right show in schematic form the circuits of the regular set of coding equipment, according to the invention, indicated in block diagram in FIG. 1; and FIG. 5 is a detail circuit showing the scheme of wiring between certain relays of the regular and interlace equipments.

Referring first to FIG. 1, the general plan of the system will be outlined. Any suitable type of speech transmitting circuit indicated diagrammatically by the microphone 20 is connected to a recording magnet 21 cooperating with a traveling magnetizable tape 22 traveling in the direction of the arrow. Spaced along the tape 22 at equal intervals are a series of reproducing magnets 23 which pick up the recorded speech with different amounts of time delay. There are five such reproducing coils shown in this figure, although any desired number may be used in practice.

These reproducer coils 23 are used as recording coils in the receiving condition to set up fragments of speech in the tape 22 in such an order that when the recorded material passes over the pick-up coil 24, normal speech is received in the receiver indicated diagrammatically at 25. An erasing coil is indicated at 26. In this simplified showing it is assumed that receivers 25 are not used for listening when speech is being transmitted from microphone 20. While the tape is illustrated in this figure as running over pulleys it will ordinarily in practice be bound around the periphery of a drum or disc in which case the various recording and reproducing coils will be spaced at regular intervals around the drum or disc.

It is the function of the scramblers 28,29, code relays 30,31 and distributor comprising segments 32 and brush 33 to switch the reproducers 23 into the transmitting line 35 in irregular order when speech is being transmitted and to switch them in circuit with the receiving line 36 also in an irregular order when speech is being received such as to restore the speech to normal in the receiver 25. For this purpose five switching circuits indicated by the boxes 37 are provided containing switching circuits individually controlled by the application of ground from the code relays 30,31 in different commutator times over individual leads 38 for individually connecting the coils to either the transmitting or receiving line. The user in talking operates the push-to-talk key 39 which places all of the switching circuits 37 under control of grounds supplied over the leads 38 for connecting coils 23 to the transmitting line 35. When the key 39 is released the switching circuits 37 are conditioned to be operated by grounds supplied over the leads 38 to connect the coils 23 to the receiving line 36. The switching circuits 37 may be constructed as disclosed in detail in D. Mitchell application Ser. No. 484,363, filed Apr. 24, 1943, now U.S. Pat. 3,012,100.

One scrambler 28 and one set of code relays 30 are termed "regular", while the other scrambler 29 and the other set of code relays 31 are termed "interlace". The regular set of code relays 30 are controlled by commutator segments 1, 2, 3, 4 and 5 while the interlace set of code relays are controlled by the alternate commutator segments 1', 2', 3', 4' and 5'. Thus, when the arm 33 sweeps over commutator segment 1 an operated code relay in the regular set 30 (selected by the scrambler 28) extends ground connection over one of the five leads 38 to corresponding switching circuit 38 to connect a particular coil 23 to either the transmitting or receiving line depending upon whether the button 39 is operated or released. As the brush 33 sweeps over commutator segment 1', ground is extended through an operated relay in the interlace set 31 (selected by scrambler 29) to a particular lead 28 to corresponding switching circuit 37 to connect one of the coils 23 to either the transmitting or receiving line. As the brush 33 sweeps over the succeeding commutator segments the coils 23 are switch into circuit alternately under control of the regular and interlace code relay sets.

The scramblers 28 and 29 determine the sequence of operation of the code relays by interconnecting input leads 41 with output leads 42 or input leads 43 with output leads 44 in irregular order for controlling the code relays. The internal construction of the scramblers can be varied widely in practice and may be of any suitable type capable of interconnecting the input and output conductors in an irregular non-recurrent order. In the more complete disclosure shown in the succeeding figures, the scrambler comprises a number of stepping switches in which switch arms are moved across banks of terminals with an irregular or haphazard scheme or wiring among the switches. By providing an unequal number of contacts on the different switches and connecting them to operate in tandem and with different numbers of switches in tandem at different times and by otherwise varying the scheme of interconnection, the scrambler is enabled to interconnect the incoming and outgoing leads in an irregular order with an extremely long code cycle. Scramblers 28 and 29 while operating in timed relation with each other generate independent codes so that the interlace scramble is determined entirely independently of the regular scramble, thus further confusing the order in which the speech segments are sent out or received.

It is necessary that the transmitting and receiving codes used in two intercommunicating stations be properly correlated so that the received scrambled message will be successfully unscrambled. The fact that, in transmitting, the scrambling is done in taking the speech segments off the tape (scramble on reproduce) while, in receiving, the unscrambling is done in recording the received speech segments on the tape (scramble on record), makes it possible to use scramblers 28 and 29 at one station which are exact duplicates of the scramblers 28 and 29 used at the opposite station. They are started in phase coincidence with each other at the opposite stations and are run in close synchronism. In practice a single drive may be used at a station for timing the scramblers, moving the commutator brush arm 33 and driving the magnetic tape 22. Synchronism of all of the parts is obtained between the different stations by insuring that the common driving means at one station runs in close synchronism with that of the other station, as may be done by means known in the art, one type being disclosed in D. Mitchell application above referred to.

Figure 2:
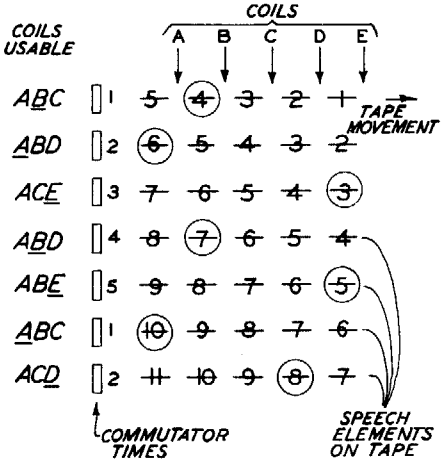
FIG. 2 is a table to be referred to in explaining the coding principle used.

An understanding of the scheme of coding in accordance with the present invention will be facilitated by first considering FIG. 2 which shows in diagram the five pick-up coils A, B, C, D and E and the positions, with respect to these coils, that different elements of the signal record occupy in successive times taken at the beginnings of successive commutator intervals. The tape is assumed to be moving to the right and the speech elements that have been recorded on the tape are numbered indicating the sequence in which they were recorded. The top row shows the positions of these recorded elements at the beginning of commutator time 1 and each succeeding row shows the elements shifted one step to the right to indicate their positions at the beginnings of later successive commutator times, the commutator segments being spread out along a vertical line at the left for convenience of reference. For simplicity no interlace coding is assumed in the diagram.

It will be assumed that speech elements 1 and 2 have been sent in the previous commutator rotation and, therefore, pick-up coils D and E are not available for selection at commutator time 1. The coils that can be selected are shown at the left for each commutator time and in time 1 they are coils A, B and C. Let it be supposed that the five speech elements 3, 4, 5, 6 and 7 are to be coded so as to be sent in the order 4, 6, 3, 7, 5. It is seen from the diagram that coil B is to be selected for use in commutator time 1 and that speech element 4 will be picked up from the record as the portion of the tape on which it is recorded passes to the right under coil B. Looking at the next line, we see that coil E is not available for the same reason that coil D was not available in the previous time. Coil E must, therefore, be excluded from use in time 2. Since speech element 4 will be under coil C in time 2, coil C must be excluded. Thus, coils A, B and D are available and since the next element to be sent is element 6, coil A is to be used. Continuing on down the diagram it is seen that two coils are always excluded and three are available, the three being indicated at the left for each commutator time.

By observing the coils that are available in each row, certain conclusions are apparent. Coil A never need be excluded. If coil A is used, it requires exclusion in the next succeeding times of each of the other coils in the order B, C, D, E. Similarly, if coil B is used, coils C, D, and E must be excluded in succession. Use of coil C requires exclusion successively of coils D and E. Use of coil D requires exclusion of coil E in the next time. Use of coil E does not require any subsequent exclusion. This can be arranged in a table as follows:

| Select A Exclude Successively | Select B Exclude Successively | Select C Exclude Successively | Select D Exclude In Next Time | Select E |
|---|---|---|---|---|
| B | C | D | E | |
| C | D | E | | |
| D | E | | | |
| E | | | | |

It will also be noted that unless coil E is excluded it must be selected since otherwise the corresponding signal element will be lost. The selection must, therefore, be such as to choose coil E in the event it is not excluded.

The last two rows in FIG. 2 indicate that on the next rotation of the commutator an entirely different code can be used from that used in the previous rotation.

A circuit in accordance with the invention for accomplishing this type of coding or decoding together with the necessary exclusion operations is shown on FIGS. 3 and 4 which will now be described assuming FIG. 3 to be placed at the left of FIG. 4. In these figures only the regular set of switching relays, code relays and scrambler are shown in detail but it will be obvious how to supply the interlace equipment from the description of the regular equipment given. The points at which the interlace switching relays, code relays and other elements are to be connected will be pointed out hereinafter.

The commutator 32 is shown in the right-hand portion of FIG. 4. Each of the regular set of segments (1, 2, 3, 4 and 5) is wired to the winding of a respective switching relay C1, C2, C3, C4 and C5. The code relays are shown on FIG. 3 at 61 to 65 and there are four exclusion relays 66 to 69, coil A never needing to be excluded. Selection of a coil is made by energizing one of the code relays 61 to 65 closing battery through front contact of the operated code relay to the corresponding switching circuit 37 associated with the desired coil. The leads from these relay contacts are shown branched, the branches leading to the code relays of the interlace set as indicated in FIG. 1.

Each switching relay C1, etc. is provided with eight armatures for performing a number of switching functions. (For convenience these will be referred to by number counting from the top down.) These and the other relays of the system must be fast relays since they operate and release in a small fraction of the time taken by the commutator brush in passing over one segment. They should have lightweight moving parts, therefore, and if in any case it is not feasible to provide the necessary number of armatures on one relay a plurality of relays may be used with their energizing windings connected in series or in parallel. One type of relay that may be used for such purposes is disclosed and claimed in W. B. Ellwood U.S. Pat. 2,289,830, dated July 14, 1942.

Beneath the switching relays are the five exclusion control relays 51 to 55 which when operated apply ground to one or another of the exclusion relays to operate the latter, depending upon the operation of the switching relays.

When commutator brush 33 sweeps over segments 1, 2, 3, etc. of the normal set, relays C1, C2, etc. are energized and released in succession. With the circuits in the condition shown in the drawing, code relay 65 (E) would be continually selected by a circuit extending through its winding, upper back contact of exclusion relay 69, conductor 70 to ground at front contact of second armature of each switching relay C1, C2, etc. as they are energized. This would occur because, as stated above, coil E is always selected unless it is excluded. In order to start the circuit, therefore, and place it in condition such that two coils are always excluded and any of the other three may be selected, the exclusion control relays 53 and 54 are first energized, by temporary closure of key 153, and they lock to grounds at the lowermost armatures of relays C3 and C4.

When brush 33 makes contact with commutator segment 1, relay C1 is energized and exclusion relays 66 and 67 operate over lower armatures and back contacts of code relays 62 and 63, conductors 72 and 73 are front contacts and armatures of relay C1 and conductors 77 and 78 to the locking grounds for relays 54 and 53. Relay 65 is operated over rest contact of exclusion relay 69 and conductor 70 to ground at second armature of relay C1 as stated. When relay 65 operates, ground at its lower armature and front contact is extended over conductor 75 and third armature and front contact of relay C1 and conductor 79 causing operation of relay 51 which locks to the back contact and second armature of relay C1' in the interlace set over conductor 81. (See partial diagram, FIG. 5, for the scheme of connection.)

When commutator brush 33 passes off segment 1 and onto segment 1' relay C1 releases and relay C1' in the interlace circuit operates. There is sufficient overlap in the brush contact with segments 1 and 1' so that both relays C1 and C1' are operated for an instant and in this instant relay 51 releases. Release of relay C1 deenergizes exclusion relays 66 and 67. Relay 65 also releases due to the opening of conductor 70 at second armature and front contact of relay C1.

When commutator brush 33 makes contact with segment 2, relay C2 is operated causing code relay 65 to operate again over the circuit previously traced except this time conductor 70 finds ground at the second armature and front contact of relay C2. Relay 52 operates over conductor 75, third armature and front contact of relay C2 and conductor 85. Exclusion relays 67 and 68 operate from locking grounds of relays 54 and 53 over conductors 77 and 78, fourth and fifth armatures and front contacts of relay C2 and rest contacts and lower armatures of code relays 63 and 64. Relay 52 is locked at top armature of relay C2' of the interlace set, over conductor 86.

When commutator brush 33 passes off segment 2 and on to segment 2' there is an instant when both relays C2 and C2' are energized during which instant relay 52 releases. Relay 65 releases by the opening of conductor 70 at the second armature and front contact of relay C2, and exclusion relays 67 and 68 release due to the opening of contacts at the fourth and fifth armatures of relay C2.

When commutator brush 33 makes contact with segment 3 relay C3 operates (relay 53 remaining locked from the top armature of relay C3'). The locking grounds of relays 54 and 53 are now extended over conductors 77 and 78 and fourth and third armatures and front contacts of relay C3, conductors 74 and 75 to windings of exclusion relays 68 and 69, the latter excluding relay 65(E). Relay 69 can be made to operate before relay 65 has time to operate by arranging a sequence of closure of the armature of the C relays or by inserting a small inductance 165 in series with the winding of relay 65, for example. With relay 65 and one other excluded, the circuit will not automatically select coil E but is free to permit the selection of any one of the coils A, B or C as may be determined by the scrambler. With relay C3 operated, it applies ground from its second armature and front contact, conductor 70, upper armature and front contact of the E exclusion relay 69 and conductor 76, top armature and front contact of relay C3, conductor 93 to the wiper of selector 103 of the scrambler from which the ground extends through one of the four conductors of the group 106 wired to the arcs of the selectors, through corresponding armature and back contact of transfer relay 107, and corresponding conductor of the group 108. If the conductor in question is 111, code relay 61 is operated by this ground causing the selection of coil A. If the conductor were 112, coil B would be selected by operation of relay 62. If the conductor were 113 or 114, coil C would be selected since relay 68 is operated and the ground would pass to the winding of relay 63 through the back contact of relay 67 from lead 113 or through the front contact of relay 68 and lead 114. When commutator brush 33 passes off segment 3, relay C3 releases opening lead 93 and releasing the selected code relay 61, 62 or 63 whichever was operated.

When relays C3 and C3' are simultaneously up, opening the locking circuit of relay 53 for an instant, relay 53 releases. When the commutator brush 33 makes contact with segment 4, relay C4 energizes.

Exclusion relay 69 (E) now is operated over lead 75 from the third armature and front contact of relay C4 and conductor 77 to the locking ground for relay 54. Assuming that the code relay that was selected in commutator interval 3 was, for example, relay 61 (A), exclusion control relay 52 will now be found energized and locked, the energizing circuit extending from lower armature and front contact of code relay 61 (A), conductor 71, seventh armature and front contact of relay C3 (which was closed when brush 33 was passing over segment 3) and conductor 90 to winding of relay 52. This relay will remain locked until relays C2 and C2′ are both momentarily energized together. In commutator time 4, therefore, a circuit is closed through the winding of exclusion relay 66 (B) through lower normal contact of code relay 62, conductor 72 and sixth armature and front contact of relay C4, conductor 85 to conductor 90 and locking ground of relay 52. In the fourth commutator time, therefore, coils B and E are excluded and coils A, C and D are available. The ground from second armature and front contact of relay C4 is sent through conductor 70, front contact on exclusion relay 69, conductor 76 and upper armature and front contact of relay C4 over conductor 94 to the wiper of the fourth scrambler arc 104, over one of the conductors 106, normal contact of relay 107, one of the conductors 108 to the energizing winding of one of the three available code relays 61 (A), 63 (C) or 64 (D). If the conductor in group 108 on which the ground appeared was either 111 or 112, relay 61 would be selected. If conductor 113, relay 63 would be selected, etc.

When relay C5 energizes in commutator time 5, relay 63 (C) will be excluded because the locking ground for relay 52 has been transferred from conductor 72 to conductor 73, the circuit passing through the fifth armature and front contact of relay C5. Assuming that the code relay selected in time 4 was relay 63 (C), in the fifth period relays 63 (C) and 64 (D) will be excluded and coils A, B and E are not excluded. Since coil E is not excluded it must automatically be selected regardless of the scrambler. This is done by the closing of the second armature of relay C5 which grounds conductor 70, relay 69 being normal. Relay 55 operates from ground at the lower armature and front contact of relay 65 (E), conductor 75, third armature and front contact of relay C5 and conductor 89 to winding of relay 55. Since the selection of coil E does not require any exclusion in the next period, relay 55 releases at the beginning of commutator time 1.

It is believed clear from the foregoing description how the code relays are individually selected under control of the scrambler and how the exclusion relays are operated. It has been pointed out how the exclusion progresses through the chain in the direction from relay 66 to relay 69 as different ones of the switching relays C1 to C5 operate in succession and transfer the locking grounds of the exclusion control relays 51, 52, etc. from one to another exclusion relay winding. Ine one sense, the exclusion relays in their successive operation follow the moving speech record on the tape so as to exclude coils as the speech record travels past them and would otherwise be picked up and used.

The scrambler will now be described. In order to allow time for the selector switches of the scrambler to step, two sets of switches are used, one set comprising selectors 101, 102 and 103 and the other set comprising selectors 104 and 105. Stepping magnets for these switches are shown at 131 to 135. The switches are stepped when these magnets are released but do not move when the magnets attract their pawls. Magnets 131, 132 and 133 are energized in parallel over conductor 136 which leads to timing sector 138 of distributor 31, FIG. 4. Brush 33 (or another brush on the same brush arm) grounds sectors 137 and 138 during alternate half cycles of the commutator. Stepping magnets 134 and 135 are energized to attract their pawls when brush 33 is traveling over sector 137, which then grounds conductor 139. Transfer relay 107 is energized during the time the ground is applied to conductor 139.

When segments 1, 2 and 3 of the commutator are being used as above described and switching relays C1, C2 and C3 place grounds on leads 91, 92 or 93, leading to wipers of selector switches 101, 102 and 103, relay 107 is deenergized so that the four conductors of the group 106 leading from selectors 101, 102 and 103 are then connected to the four conductors of the group 108 for controlling the code relays. At the end of time 3 the commutator brush 33 passes off segment 3 and onto segment 3′. Ground from sector 138 is broken and ground is made to sector 137. Relay 107 energizes and the stepping magnets 134 and 135 pull up their pawls while the brush 33 is passing over segment 3′ but switches 104 and 105 do not move. Switches 101, 102 and 103, however, take a step since their stepping magnets release. During commutator times 4 and 5 switching relays C4 and C5 may place grounds on leads 94 and 95 leading to wipers of selector switches 104 and 105 and the four output leads 116 from these switches are now connected through front contacts of relay 107 to conductors 108 for selecting code relays 61 to 64.

After brush 33 passes off sector 137 and segment 5′ onto segment 1, relay 107 releases to reconnect conductors 106 to conductors 108 but switches 101, 102 and 103 are already in position since they advanced one step a half cycle previously.

In the interlace selector a similar arrangement is used except that selectors 103′, 104′ and 105′ from one group and selectors 101′ and 102′ form the other group.

The connections between the selector arcs and the individual conductors in groups 106 and 116 are varied so as to give as irregular a scheme as possible in the order of selection of the conductors among the switches. For simplicity of circuit drawing, only one rank of selectors is shown but it will be understood that this is intended to illustrate any suitable type of scrambler and that in practice the ground that is extended through the scrambler could be made to pass through several selectors in tandem as is shown more fully in the Busch-Cahill-Myers application referred to and that the stepping of these tandem selectors could be done in irregular manner so as to provide an extremely long cycle before repetition begins.

What is claimed is:

1. In a privacy system in which the signals are divided into fragments on a time basis and the different fragments are delayed in transmission by different amounts to afford privacy, a timing means having a timing cycle divided into several periods, a relay individual to each period and individually operated during its respective period by said timing means, a plurality of delay devices to introduce delay into said signals, means controlled by said timing means to select a delay device for each timing period, and means jointly controlled by said relays and selecting means to operate the selected devices.

2. In a privacy system comprising a traveling signal storage element and a succession of translator devices spaced along said element for introducing different amounts of delay into the signals, a timing device for dividing a timing cycle into time intervals, means operable from said timing device in each time interval to select a translator device for use in that interval, and means operable in each interval for confining the selection to only those translator devices that are not in position to repeat an already used signal portion.

3. In a privacy system comprising a traveling signal storage element and a succession of translator devices spaced along said element for introducing different amounts of delay into the signals, a timing device for dividing a timing cycle into time intervals, a scrambler, an exclusion relay circuit, a plurality of switching devices, and means to operate a different switching device each interval, each switching device when operated closing one circuit leading into the scrambler to effect selection of one of said translator devices and closing another circuit leading to said exclusion relay circuit for modifying the selection made by said scrambler.

4. In a privacy system comprising a traveling signal storage element and a succession of translator devices spaced along said element for introducing different amounts of delay into the signals, a timing device for dividing a timing cycle into time intervals, means to select one of said devices in each time interval, and means for preventing selection of devices that would repeat the translation of the same signal comprising a plurality of exclusion relays and means to operate them individually and successively in successive time intervals.

5. In a privacy system comprising a traveling signal storage element and a succession of translator devices spaced along said element for introducing different amounts of delay into the signals, a timing device for dividing a timing cycle into time intervals, circuits for individually selecting said devices in successive time intervals for use in the same interval, a plurality of exclusion relays individually controlling said circuits, and means to transfer the energizing circuit of said relays from one to the next in successive time intervals to prevent use of more than one translator device for the same signal element.

6. In a privacy system comprising a traveling signal storage element and a succession of translator devices spaced along said element for introducing different amounts of delay into the signal, a timing device for dividing a timing cycle into time intervals, circuits for individually selecting said devices in successive time intervals for use in the same interval, and means operable in response to the selection of a given device in one interval for preventing the selection of the next succeeding device in the following interval.

7. In a privacy system comprising a traveling signal storage element and a succession of translator devices spaced along said element for introducing different amounts of delay into the signals, a timing device for dividing a timing cycle into time intervals, means operable in each interval to select a device for use in that interval, an exclusion relay for each of a plurality of said devices, and means to energize said exclusion relays in successive order in succeeding time intervals including means to begin such energization with the relay corresponding to the device following that used in the next preceding time interval.

8. In a privacy system using a traveling magnetic tape and a plurality of electromagnets in magnetizing relation to said tape and spaced along said tape to effect delays in signals, timing means for dividing a signal into fragments of one time unit duration, switching relay means operable from said timing means in each time unit, and circuits controlled by said relay means for selecting one of said electromagnets for use in the same time unit and for preventing the selection of the electromagnet immediately following the one selected in the next preceding time unit.

9. In a privacy system comprising a traveling signal storage element and a succession of translator devices spaced along said element for introducing different amounts of delay into the signals, a timing device for dividing a timing cycle into time intervals, a signaling circuit, means operable in each time interval for selecting and connecting into said signaling circuit an individual one of said devices, and means simultaneously operable to progressively exclude from use the devices which coincide in position with stored signal elements that have already been translated by a previous device.

10. In a privacy system, a signal circuit, a moving magnetizable tape, electromagnets spaced along said tape in magnetizable relation thereto, a commutator having segments, relay means individually connected to said segments to be operated therefrom, and means operable in response to the operation of each relay means for selecting one of said electromagnets for use in translating signals between said tape and said circuit, said last means including means controlled from said relay means for preventing selection of an electromagnet following in position along said tape a previously used electromagnet by the distance traversed by a point on the tape in the time elapsed since the selection of said previously used electromagnet.

11. In a privacy system comprising a moving magnetizable tape and a succession of electromagnets spaced along said tape in magnetizable relation thereto, a signal circuit and a commutator, individual relay means connected to segments of said commutator and operated therefrom, scrambler means operative in response to the operation of each relay means to select one of said electromagnets and connect the same to said signal circuit, a set of exclusion relays, a set of exclusion control relays, and means jointly controlled by said individual relay means and said exclusion control relays for operating an exclusion relay each time of said individual relay means operates, said exclusion relays preventing selection of certain of said slectromagnets.

12. In a privacy system comprising a moving magnetizable tape and a succession of electromagnets spaced along said tape in magnetizable relation thereto, a signal circuit and a commutator, a code relay per electromagnet, said relays when operated individually connecting the corresponding electro-magnet to said signal circuit, a selector switch, a set of exclusion relays, an individual circuit controlled from each commutator segment, each such circuit when closed effecting operation of a code relay, each such circuit including a break closable by said selector switch and a further break closable by an exclusion relay.

* * * * *